US009542893B2

(12) United States Patent
Yamaguchi et al.

(10) Patent No.: US 9,542,893 B2
(45) Date of Patent: Jan. 10, 2017

(54) IMAGE DISPLAY DEVICE, RECORDING MEDIUM, AND METHOD TO CONTROL LIGHT SOURCES BASED UPON GENERATED APPROXIMATE CURVES

(71) Applicant: Sharp Kabushiki Kaisha, Osaka-shi, Osaka (JP)

(72) Inventors: Noriaki Yamaguchi, Osaka (JP); Naoko Kondoh, Osaka (JP); Shigeto Yoshida, Osaka (JP)

(73) Assignee: SAHRP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/410,457

(22) PCT Filed: Aug. 7, 2013

(86) PCT No.: PCT/JP2013/071328
§ 371 (c)(1),
(2) Date: Dec. 22, 2014

(87) PCT Pub. No.: WO2014/038336
PCT Pub. Date: Mar. 13, 2014

(65) Prior Publication Data

US 2015/0325175 A1 Nov. 12, 2015

(30) Foreign Application Priority Data

Sep. 7, 2012 (JP) ..... 2012-197789

(51) Int. Cl.
*G09G 3/36* (2006.01)
*G09G 3/34* (2006.01)
*G09G 3/20* (2006.01)

(52) U.S. Cl.
CPC ..... *G09G 3/342* (2013.01); *G09G 3/20* (2013.01); *G09G 3/34* (2013.01); *G09G 3/3413* (2013.01);
(Continued)

(58) Field of Classification Search
CPC ..... G09G 3/36; G09G 3/3644; G09G 3/3666; G09G 2320/0686; G09G 3/342; G09G 2320/0233; G09G 2320/0285
(Continued)

(56) References Cited

U.S. PATENT DOCUMENTS

2005/0184952 A1 8/2005 Konno et al.
2006/0139270 A1* 6/2006 Hong ..... G09G 3/3406 345/87
(Continued)

FOREIGN PATENT DOCUMENTS

JP 2008-051905 A 3/2008
JP 2009139470 A 6/2009
(Continued)

OTHER PUBLICATIONS

International Search Report PCT/ISA/210 for International Application No. PCT/JP2013/071328 Dated Nov. 12, 2013.
(Continued)

*Primary Examiner* — Alexander Eisen
*Assistant Examiner* — Nelson Lam
(74) *Attorney, Agent, or Firm* — Harness, Dickey & Pierce, P.L.C.

(57) ABSTRACT

A local failure of display video is suppressed. An LED data calculating portion that generates an approximate curve obtained by approximating the distribution of values of an input image, the approximate curve whose amount of change is less than or equal to a predetermined value, and calculates LED data based on the generated approximate
(Continued)

curve and a liquid crystal transmittance calculating portion that calculates the liquid crystal transmittance based on the input image and the approximate curve generated by the LED data calculating portion are provided.

4 Claims, 9 Drawing Sheets

(52) U.S. Cl.
CPC ..... *G09G 3/36* (2013.01); *G09G 2310/0232* (2013.01); *G09G 2320/0233* (2013.01); *G09G 2320/0285* (2013.01)

(58) Field of Classification Search
USPC ..... 345/87–104
See application file for complete search history.

(56) References Cited

U.S. PATENT DOCUMENTS

2007/0152926 A1* 7/2007 Kwon ..... G09G 3/3426 345/82
2008/0129680 A1* 6/2008 Kimura ..... G09G 3/3426 345/102
2008/0297467 A1* 12/2008 Hsu ..... G09G 3/3406 345/102
2009/0140975 A1 6/2009 Nonaka et al.
2009/0219244 A1* 9/2009 Fletcher ..... G09G 3/3406 345/102
2009/0284545 A1* 11/2009 Watanabe ..... G09G 3/3406 345/589
2010/0066657 A1* 3/2010 Park ..... G09G 3/342 345/94
2010/0066752 A1* 3/2010 Watanuki ..... G09G 3/3426 345/589
2010/0295877 A1* 11/2010 Yun ..... G09G 3/3406 345/690
2011/0157255 A1* 6/2011 Hsu ..... G09G 3/342 345/690
2015/0302789 A1* 10/2015 Furihata ..... G09G 3/2007 345/694
2016/0035293 A1* 2/2016 Furihata ..... G09G 3/36 345/694

FOREIGN PATENT DOCUMENTS

JP 2009-192963 A 8/2009
JP 2010-256912 A 11/2010

OTHER PUBLICATIONS

Written Opinion of the International Searching Authority PCT/ISA/237 for International Application No. PCT/JP2013/071328 Dated Nov. 12, 2013.

* cited by examiner

IMAGE DISPLAY DEVICE, RECORDING MEDIUM, AND METHOD TO CONTROL LIGHT SOURCES BASED UPON GENERATED APPROXIMATE CURVES

TECHNICAL FIELD

The present invention relates to an image display device having the function of controlling the luminance of a backlight (backlight dimmer utility), a method for controlling the image display device, a control program, and a recording medium.

BACKGROUND ART

In an image display device provided with a backlight, such as a liquid crystal display device, by controlling the luminance of the backlight based on an input image, it is possible to suppress power consumption of the backlight and improve the image quality of a display image. In particular, by dividing a screen into a plurality of areas and controlling the luminance of a backlight light source corresponding to an area based on an input image in the area, it is possible to achieve lower power consumption and higher image quality. Hereinafter, a method that drives a display panel while controlling the luminance of a backlight light source based on an input image in an area in this manner will be referred to as "area active driving".

In an image display device that performs area active driving, as a backlight light source, for example, RGB light emitting diodes (LEDs), a white LED, or the like is used. The luminance of LEDs corresponding to each area (the luminance at the time of light emission) is determined based on a maximum value, an average value, or the like of the luminance of pixels in each area and is provided to a driving circuit for a backlight as LED data. Moreover, data for display (in a liquid crystal display device, data for controlling the light transmittance of a liquid crystal) is generated based on the LED data and an input image, and the data for display is provided to a driving circuit for a display panel. In the case of the liquid crystal display device, the luminance of each pixel on the screen is the product of the luminance of light from the backlight and the light transmittance based on the data for display.

Incidentally, the light emitted from the LEDs in a certain area illuminates not only the area, but also surrounding areas. In other words, a certain area is illuminated with not only the light emitted from the LEDs of the area, but also the light emitted from the LEDs of the surrounding areas. Thus, the luminance displayed in each area has to be calculated in consideration of diffusion (spreading) of the light emitted from each LED.

For this reason, in the past, there has been a method for avoiding a failure of an output image by correcting data for display by generating a correction table by measuring the actual luminance distribution. For example, in PTL 1, calculating the light transmittance of a display element based on an input image and the display luminance corrected in consideration of diffusion from the LED data for each area is described. Moreover, in PTL 2, calculating the light transmittance by correcting an input image in order to eliminate the unevenness of the luminance of adjacent areas in area active driving is described.

CITATION LIST

Patent Literature

PTL 1: Japanese Unexamined Patent Application Publication No. 2009-192963

PTL 2: Japanese Unexamined Patent Application Publication No. 2010-256912

SUMMARY OF INVENTION

Technical Problem

However, in the above-described existing techniques, it is difficult to convert the measured luminance distribution obtained by actual measurement into numbers completely. This sometimes creates the disparity between the corrected display luminance and the measured luminance, making it impossible to calculate appropriate light transmittance. As a result, a failure is sometimes caused in an output image.

Specifically, the problems of the existing techniques will be described based on FIGS. 17 to 23.

When an input image 61 depicted in FIG. 17 is input, in the existing techniques, LED data depicted in FIG. 18 is generated. Incidentally, in FIG. 17, a point A is a central point of a white circle, a point B is a right end point of the input image 61, a point C is a boundary point between the white circle (80%) and a background (20%) on the line A-B, and a point D is a boundary point of a backlight control area on the line A-B.

At this time, the liquid crystal transmittance determined by division of the LED data from the input image based on the input image 61 and the LED data depicted in FIG. 18 is depicted in FIG. 19. However, as described above, if LEDs are driven based on the LED data depicted in FIG. 18, in actuality, a luminance distribution depicted in FIG. 21 is obtained. Therefore, in this case, in the luminance distribution of the output image, a failure of video is caused near a D point as depicted in FIG. 20.

Thus, the above-described existing techniques avoid a failure of the luminance distribution of an output image by generating a correction table by measuring the actual luminance distribution depicted in FIG. 21 and correcting the liquid crystal transmittance with the correction table. The liquid crystal transmittance at this time is depicted in FIG. 22. However, it is difficult to convert the luminance distribution depicted in FIG. 21 into numbers completely. Therefore, it is impossible to correct the liquid crystal transmittance appropriately, and a failure is sometimes caused in the luminance distribution of an output image as depicted in FIG. 23. In particular, in the existing techniques, since the LED data of each area and the liquid crystal transmittance are controlled independently, a failure of display video is sometimes caused locally, such as generation of Halo between C and D as depicted in FIG. 23.

Moreover, when a measured luminance distribution is reproduced with a high degree of accuracy to avoid this problem, the size of a circuit that performs calculation processing is increased, resulting in an increase in cost.

The present invention has been made in view of the above-described problems, and an object thereof is to provide an image display device that suppresses a local failure of display video, a method for controlling the image display device, a control program, and a recording medium.

Solution to Problem

To solve the above-described problems, an image display device according to the present invention is an image display device in which a plurality of light sources are arranged along one side or two sides of a display panel, the image display device including: an approximate curve generating means that generates an approximate curve obtained by approximating the distribution of values of an input image, the approximate curve whose amount of change is less than or equal to a predetermined value; a light source data calculating means that calculates light source data for controlling outputs of the plurality of light sources based on the approximate curve generated by the approximate curve generating means; a light transmittance calculating means that calculates the light transmittance for controlling the light transmittance of the display panel based on the input image and the approximate curve generated by the approximate curve generating means; a light source driving means that drives the plurality of light sources based on the light source data calculated by the light source data calculating means; and a display panel driving means that drives the display panel based on the light transmittance calculated by the light transmittance calculating means.

Moreover, to solve the above-described problems, a method for controlling an image display device according to the present invention is a method for controlling an image display device in which a plurality of light sources are arranged along one side or two sides of a display panel, the method including: an approximate curve generating step of generating an approximate curve obtained by approximating the distribution of values of an input image, the approximate curve whose amount of change is less than or equal to a predetermined value; a light source data calculating step of calculating light source data for controlling outputs of the plurality of light sources based on the approximate curve generated in the approximate curve generating step; a light transmittance calculating step of calculating the light transmittance for controlling the light transmittance of the display panel based on the input image and the approximate curve generated in the approximate curve generating step; a light source driving step of driving the plurality of light sources based on the light source data calculated in the light source data calculating step; and a display panel driving step of driving the display panel based on the light transmittance calculated in the light transmittance calculating step.

In the above-described configuration, the light source data calculating means calculates light source data based on an approximate curve obtained by approximating the distribution of values (pixel values or picture element values) of the input image, the approximate curve whose amount of change is less than or equal to a predetermined value. Moreover, the light transmittance calculating means calculates the light transmittance based on the same approximate curve. Since the amounts of change of the adjacent light sources are less than or equal to the predetermined value, it is possible to prevent the luminance distribution indicated by the light source data from being greatly different locally from the actual luminance distribution observed when the plurality of light sources are driven based on the light source data. Therefore, the advantage that it is possible to prevent a failure of display video which is caused locally as compared to an existing example is produced.

Moreover, it is preferable that the image display device according to the present invention further includes an image evaluating means that divides the input image into a plurality of areas, identifies an evaluation value indicating the magnitude of the luminance of each area, and generates an evaluation value string in which the evaluation values of the areas are arranged in order and the approximate curve generating means generates the approximate curve by approximating the evaluation value string.

Furthermore, in the image display device according to the present invention, it is preferable that the image evaluating means identifies the maximum value of a pixel value or a picture element value included in the area as an evaluation value of the area.

In addition, in the image display device according to the present invention, it is preferable that the image evaluating means identifies the average value of pixel values or picture element values included in the area as an evaluation value of the area.

In addition, in the image display device according to the present invention, it is preferable that the image evaluating means creates a histogram of pixel values or picture element values included in the area and identifies the most common pixel value or picture element value as an evaluation value of the area.

Moreover, in the image display device according to the present invention, it is preferable that the approximate curve generating means generates a B spline curve from the evaluation value string.

Furthermore, in the image display device according to the present invention, it is preferable that the light transmittance calculating means calculates the light transmittance based on the following equations.

$$\mathrm{LCD_rate}(i,j)=\mathrm{Offset}+(\mathrm{Index_Max}-\mathrm{LCDP}_j)/\mathrm{Index_Max}$$

$$\mathrm{Assist}(i,j,c)=(1-\mathrm{Cin}(i,j,c))*\mathrm{LCD_rate}(i,j)*K$$

$$\mathrm{Cout}(i,j,c)=\mathrm{Cin}(i,j,c)+(\mathrm{Cin}(i,j,c)*\mathrm{Assist}(i,j,c))$$

Cin(i,j,c): a picture element value of a pixel in the i-th row and the j-th column of the input image Cout(i,j,c): the light transmittance of a picture element of a pixel in the i-th row and the j-th column K: an arbitrary value Offset: an overall evaluation value indicating the magnitude of the luminance of the entire input image $\mathrm{LCDP}_j$: a value corresponding to a pixel in the j-th column in the approximate curve Index_Max: a maximum value of the evaluation value string Moreover, to solve the above-described problems, an image display device according to the present invention is an image display device in which a plurality of light sources are arranged in a matrix on the back of a display panel, the image display device including: an approximate curve generating means that generates a horizontal component approximate curve and a vertical component approximate curve which are obtained by approximating the distribution of values of an input image, the horizontal component approximate curve and the vertical component approximate curve whose amounts of change are less than or equal to a predetermined value; a light source data calculating means that calculates light source data for controlling outputs of the plurality of light sources based on the horizontal component approximate curve and the vertical component approximate curve generated by the approximate curve generating means; a light transmittance calculating means that calculates the light transmittance for controlling the light transmittance of the display panel based on the input image and the horizontal component approximate curve and the vertical component approximate curve generated by the approximate curve generating means; a light source driving means that drives the plurality of light sources based on the light source data calculated by the light source data calculating means; and a display panel driving means that drives the display panel based on the light transmittance calculated by the light transmittance calculating means.

Incidentally, the image display device may be implemented by a computer, and, in this case, by operating the computer as the means of the image display device, a control program that implements the image display device by the computer and a computer-readable recording medium on which the control program is recorded are also included in the present invention.

Advantageous Effects of Invention

As described above, an image display device according to the present invention includes an approximate curve generating means that generates an approximate curve obtained by approximating the distribution of values of an input image, the approximate curve whose amount of change is less than or equal to a predetermined value, a light source data calculating means that calculates light source data for controlling outputs of the plurality of light sources based on the approximate curve generated by the approximate curve generating means, a light transmittance calculating means that calculates the light transmittance for controlling the light transmittance of the display panel based on the input image and the approximate curve generated by the approximate curve generating means, a light source driving means that drives the plurality of light sources based on the light source data calculated by the light source data calculating means, and a display panel driving means that drives the display panel based on the light transmittance calculated by the light transmittance calculating means.

Moreover, a method for controlling an image display device according to the present invention includes an approximate curve generating step of generating an approximate curve obtained by approximating the distribution of values of an input image, the approximate curve whose amount of change is less than or equal to a predetermined value, a light source data calculating step of calculating light source data for controlling outputs of the plurality of light sources based on the approximate curve generated in the approximate curve generating step, a light transmittance calculating step of calculating the light transmittance for controlling the light transmittance of the display panel based on the input image and the approximate curve generated in the approximate curve generating step, a light source driving step of driving the plurality of light sources based on the light source data calculated in the light source data calculating step, and a display panel driving step of driving the display panel based on the light transmittance calculated in the light transmittance calculating step.

Therefore, the advantage that it is possible to prevent a failure of display video which is caused locally as compared to an existing example is produced.

DESCRIPTION OF EMBODIMENTS

An embodiment of the present invention will be described as follows based on FIGS. 1 to 15.

[The Configuration of a Liquid Crystal Display Device]

Figure 1:
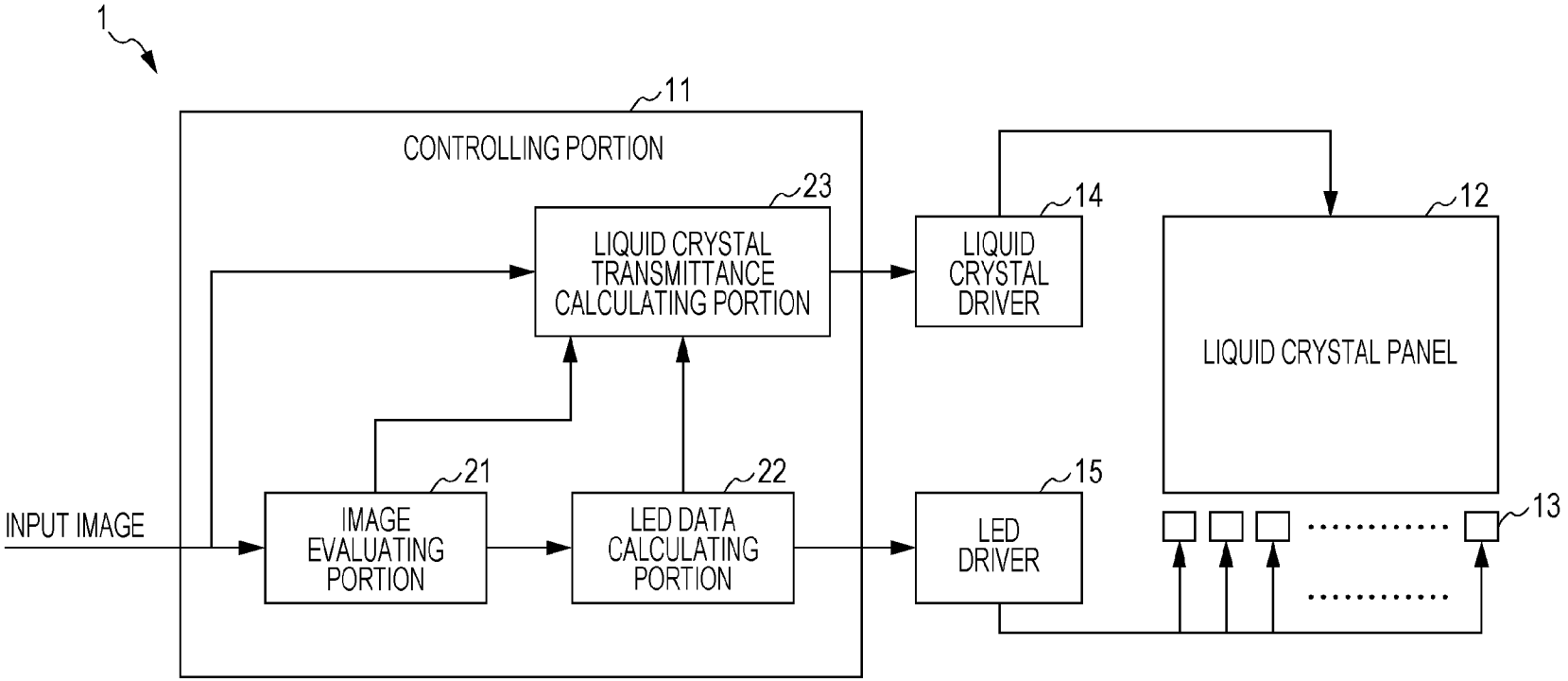
FIG. 1 depicts an embodiment of the present invention and is a block diagram depicting the configuration of principal portions of a liquid crystal display device.

FIG. 1 is a block diagram depicting an example of the configuration of principal portions of a liquid crystal display device (an image display device) 1. As depicted in FIG. 1, the liquid crystal display device 1 includes a controlling portion 11, a liquid crystal panel (a display panel) 12, LEDs (a light source) 13, a liquid crystal driver (a display panel driving means) 14, and an LED driver (a light source driving means) 15.

The liquid crystal panel 12 is a liquid crystal display element on which pixels are arranged in a matrix. Each pixel includes subpixels in which color filters that allow red (R), green (G), and blue (B) lights to pass therethrough are disposed. Moreover, the liquid crystal panel 12 has a display surface on which an image can be displayed.

Incidentally, the number of colors of the color filters disposed in the subpixel is not limited to three mentioned above and may be two or four, for example. Furthermore, in this embodiment, it is assumed that the number of pixels of the liquid crystal panel 12 is 1920×1080 (full HD). However, the number is not limited thereto, and the liquid crystal panel 12 may have an arbitrary number of pixels.

The LEDs 13 emit light from the back (a surface opposite to a surface on which an image is displayed) side of the liquid crystal panel 12 via a light guide plate. That is, the LEDs 13 function as a backlight. As depicted in FIG. 1, the LEDs 13 are arranged along one long side of the liquid crystal panel 12. In this embodiment, it is assumed that 48 LEDs are arranged.

Incidentally, the light source which is used as the backlight of the liquid crystal display device 1 is not limited to the LED and may be any light source. Moreover, in this embodiment, an edge light scheme is adopted and the LEDs 13 are arranged only on one long side of the liquid crystal panel 12, but the arrangement is not limited thereto. For example, the LEDs 13 may be arranged along the two sides: the long side and the short side of the liquid crystal panel 12. Furthermore, a direct-type scheme may be adopted and the LEDs 13 may be arranged on the back side of the liquid crystal panel 12. In addition, in this embodiment, 48 LEDs 13 are arranged; however, an arbitrary number of LEDs 13 may be used.

The liquid crystal driver 14 is a driving circuit that drives the liquid crystal panel 12 based on an instruction from the controlling portion 11. Specifically, the liquid crystal driver 14 controls the liquid crystal transmittance of each pixel (each subpixel) by applying a voltage to each pixel (each subpixel) of the liquid crystal panel 12.

The LED driver 15 is a driving circuit that drives each LED 13 based on an instruction (LED data) from the controlling portion 11. That is, the LED driver 15 controls the intensity of light emitted by each LED 13. More specifically, the LED driver 15 acquires an LED data string from the controlling portion 11 and controls the output of each LED 13 based on the acquired LED data string. Here, the LED data string is what is obtained by arranging the LED data indicating the output of each LED 13 in the order in which the LEDs 13 are arranged. That is, in this embodiment, the LED data string is what is obtained by arranging 48 pieces of LED data.

The controlling portion 11 is formed of a microcomputer and so forth and controls the entire liquid crystal display device 1 by controlling the portions of the liquid crystal display device 1. In this embodiment, the controlling portion 11 has a configuration provided with, as functional blocks, an image evaluating portion (an image evaluating means) 21, an LED data calculating portion (an approximate curve generating means, a light source data calculating means) 22, and a liquid crystal transmittance calculating portion (a light transmittance calculating means) 23. These functional blocks (21 to 23) of the controlling portion 11 may be implemented as a result of a central processing unit (CPU) reading a program stored in a storage device implemented by read only memory (ROM) or the like temporarily into a storing portion implemented by random access memory (RAM) or the like and executing the program. Moreover, the functional blocks (21 to 23) may be implemented by hardware, not software.

The image evaluating portion 21 acquires an input image from the outside of the liquid crystal display device 1 and analyzes the acquired input image. Specifically, the image evaluating portion 21 divides the input image into a plurality of areas, identifies an evaluation value of each area, and generates an evaluation value string in which the evaluation values of the areas are arranged in order. At the same time, the image evaluating portion 21 identifies an evaluation value of the entire input image. Here, the evaluation value is an indicator indicating the magnitude of the luminance of a certain region. The image evaluating portion 21 outputs the evaluation value string to the LED data calculating portion 22 and outputs the evaluation value of the entire input image to the liquid crystal transmittance calculating portion 23. Incidentally, in the following description, the evaluation value of the entire input image is referred to as an overall evaluation value.

The LED data calculating portion 22 calculates LED data (light source data) based on the analysis result of the image evaluating portion 21. Specifically, the LED data calculating portion 22 acquires the evaluation value string from the image evaluating portion 21, generates an approximate curve based on the evaluation value string, and calculates LED data from the generated approximate curve. The LED data calculating portion 22 outputs the calculated LED data to the LED driver 15. Moreover, the LED data calculating portion 22 outputs the generated approximate curve to the liquid crystal transmittance calculating portion 23.

The liquid crystal transmittance calculating portion 23 acquires an input image from the outside of the liquid crystal display device 1 and, at the same time, acquires the overall evaluation value from the image evaluating portion 21 and the approximate curve from the LED data calculating portion 22. Then, the liquid crystal transmittance calculating portion 23 calculates a correction coefficient from the acquired input image, approximate curve, and overall evaluation value and calculates the liquid crystal transmittance (light transmittance) based on the acquired input image and the calculated correction coefficient. The liquid crystal transmittance calculating portion 23 outputs the calculated fluid volume transmittance to the liquid crystal driver 14.

Incidentally, the image evaluating portion 21 and the liquid crystal transmittance calculating portion 23 acquire an input image from the outside of the liquid crystal display device 1; however, the embodiment is not limited thereto. If the liquid crystal display device 1 includes a storing portion (not depicted), the image evaluating portion 21 and the liquid crystal transmittance calculating portion 23 may acquire an input image by reading an image from the storing portion.

[Display Processing of the Liquid Crystal Display Device]

Figure 2:
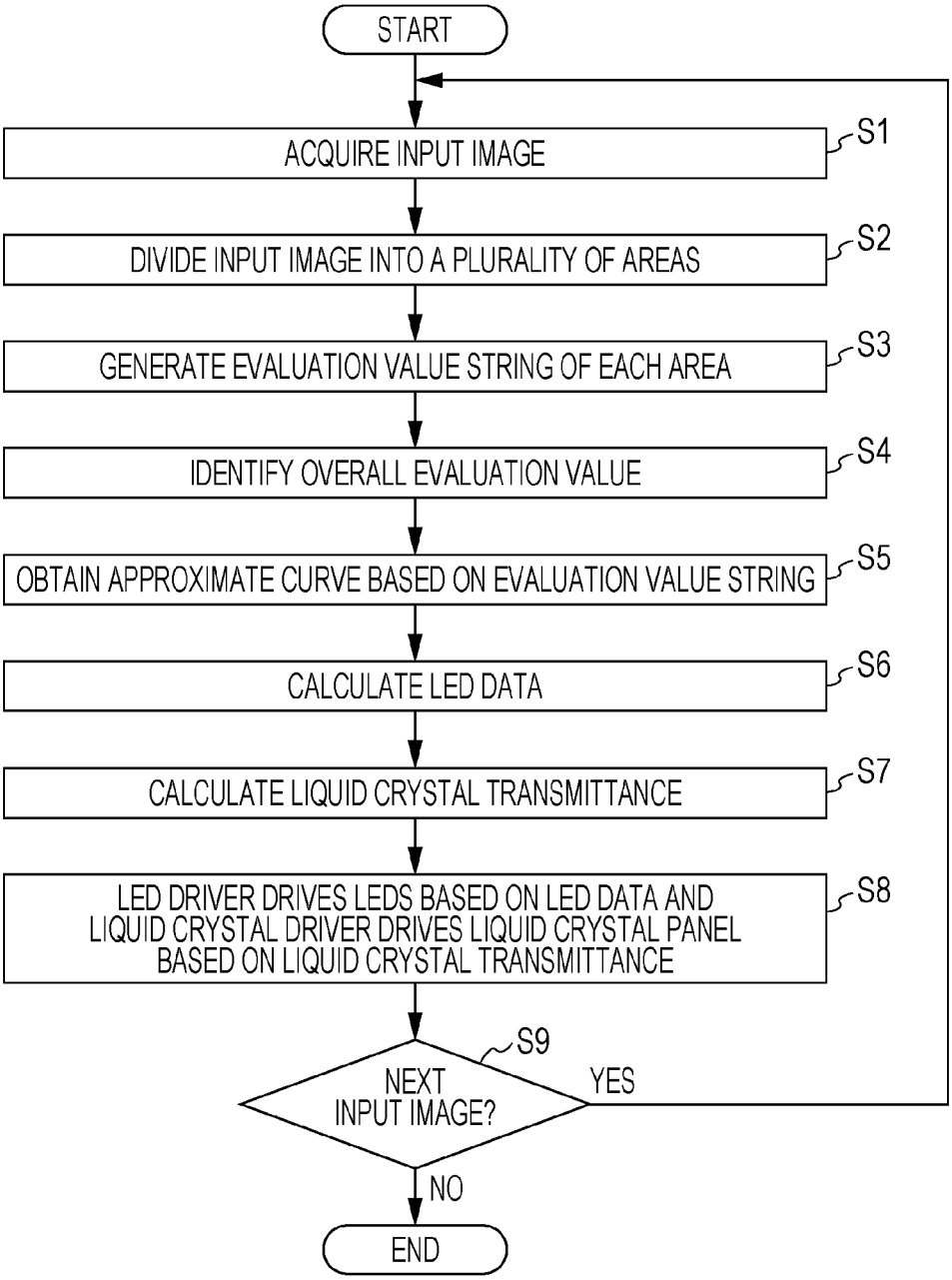
FIG. 2 is a flowchart depicting an example of display processing which is performed by the liquid crystal display device.

Next, an example of display processing which is performed by the liquid crystal display device 1 will be described based on FIG. 2. FIG. 2 is a flowchart depicting an example of the display processing which is performed by the liquid crystal display device 1.

As depicted in FIG. 2, first, the image evaluating portion 21 and the liquid crystal transmittance calculating portion 23 acquire an input image from the outside of the liquid crystal display device 1 (S1). Next, the image evaluating portion 21 divides the acquired input image into a plurality of areas (S2). Then, the image evaluating portion 21 identifies an evaluation value of each area and generates an evaluation value string in which the evaluation values of the areas are arranged in order (S3). Furthermore, the image evaluating portion 21 identifies an overall evaluation value from the input image (S4).

Next, the LED data calculating portion 22 generates an approximate curve based on the evaluation value string generated by the image evaluating portion 21 (S5). Then, the LED data calculating portion 22 calculates LED data from the generated approximate curve (S6).

Moreover, the liquid crystal transmittance calculating portion 23 calculates a correction coefficient from the acquired input image, the approximate curve generated by the LED data calculating portion 22, and the overall evaluation value identified by the image evaluating portion 21 and calculates the liquid crystal transmittance based on the acquired input image and the calculated correction coefficient (S7).

Then, the LED driver 15 drives the LEDs 13 based on the LED data calculated by the LED data calculating portion 22, and the liquid crystal driver 14 drives the liquid crystal panel 12 based on the liquid crystal transmittance calculated by the liquid crystal transmittance calculating portion 23 (S8).

If there is a next input image (YES in S9), S1 to S8 described above are repeated; if there is no next input image (NO in S9), the display processing is ended.

Example

Next, specific processing examples of the image evaluating portion 21, the LED data calculating portion 22, and the liquid crystal transmittance calculating portion 23 will be described based on FIGS. 3 to 10.

Incidentally, here, it is assumed that an input image has 0 to 255 (8-bit)-step gradation, a pixel is one pixel including RGB, and a picture element is an R, G, or B subpixel. Moreover, the value of LED data is assumed to be 10 bit: 0 to 1023.

(A Processing Example of the Image Evaluating Portion)

Figure 3:
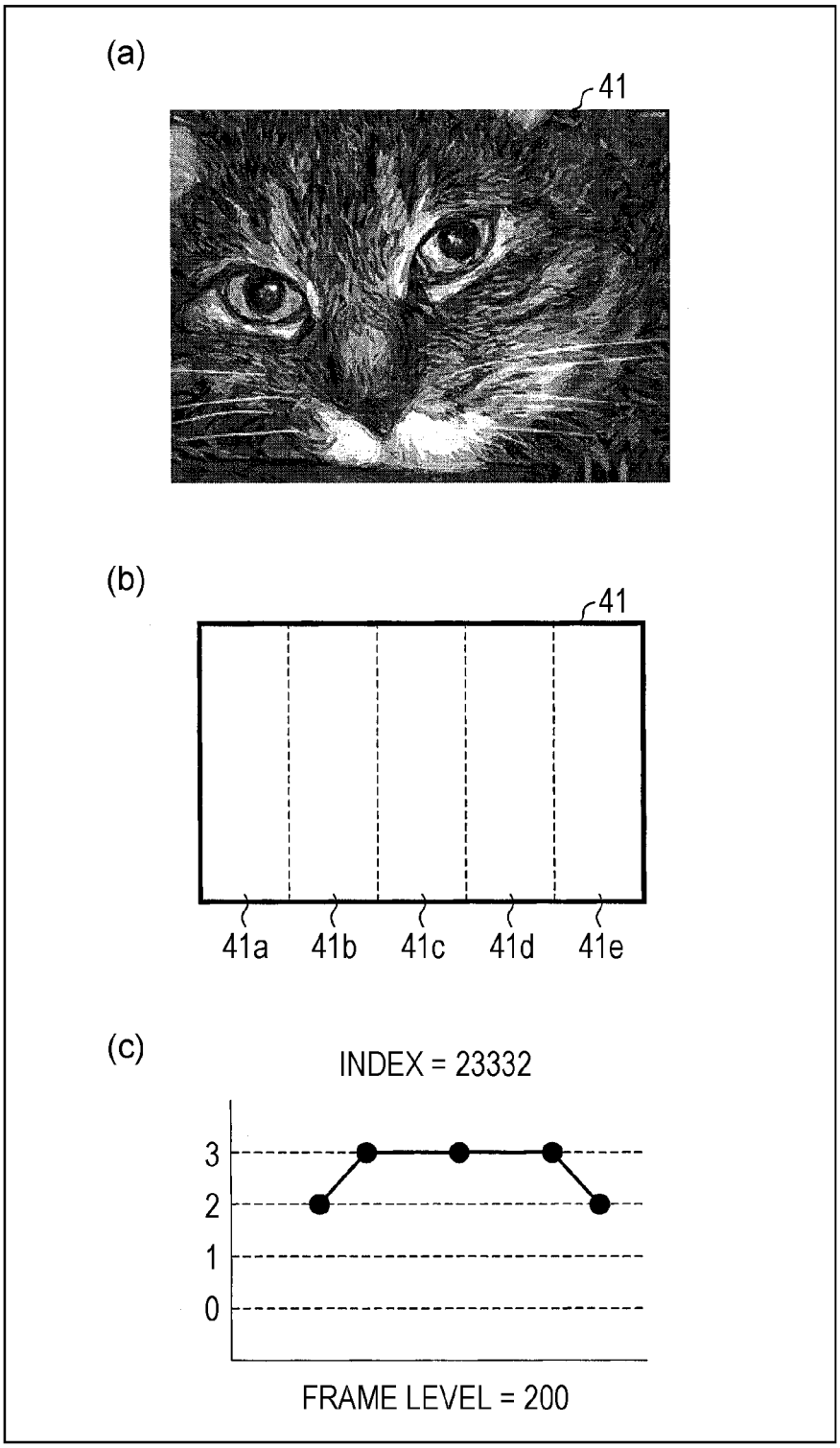
FIG. 3 is a diagram depicting an outline of a processing example of an image evaluating portion of the liquid crystal display device.

First, a processing example of the image evaluating portion 21 will be described based on FIG. 3. FIG. 3 is a diagram depicting an outline of the processing example of the image evaluating portion 21.

As depicted in FIG. 3(*b*), the image evaluating portion 21 vertically divides an input image 41 depicted in FIG. 3(*a*) into five areas 41*a* to 41*e* with respect to a long-side direction. However, the input image division method is not limited thereto. In this embodiment, since the LEDs 13 are arranged in the long-side direction of the liquid crystal panel 12, the input image 41 is vertically divided with respect to the long-side direction. For example, if the LEDs 13 are arranged in a short-side direction of the liquid crystal panel 12, the input image 41 is vertically divided with respect to the short-side direction.

Moreover, as long as the input image is vertically divided with respect to the direction in which the LEDs 13 are arranged, the number of areas, the area thereof, and so forth may be arbitrarily set. For example, in an example depicted in FIG. 3(*b*), division into five areas 41*a* to 41*e* is performed, but other division may be performed as long as division into a plurality of areas is performed. Furthermore, in the example depicted in FIG. 3(*b*), the input image 41 is divided into five equal parts, but the five areas 41*a* to 41*e* may differ from one another. Incidentally, it is desirable that the number of areas is an odd number in order to obtain an evaluation value at a center of an input image. Moreover, the larger the number of areas, the higher the accuracy of evaluation. However, since the accuracy of evaluation is not improved if the number of areas exceeds the number of LEDs 13, it is desirable to set the number of areas so as to be less than or equal to the number of LEDs 13.

Next, a method for identifying an evaluation value will be described. In this example, first, the image evaluating portion 21 extracts the maximum value of a picture element value in an area for each of the areas 41*a* to 41*e* and sets it as a representative value. For example, if there are n pixels in the area 41*a* and R1, G1, B1=(10, 20, 30), . . . , Rn, Gn, Bn=(100, 150, 100), 150 which is a maximum value is set as a representative value of the area 41*a*.

Here, the method for extracting a representative value is not limited to the above-mentioned example. For example, a pixel value in an area, not a picture element value in the area, may be referred to. Moreover, the average value of pixel values or picture element values in an area may be used as a representative value. Furthermore, a histogram of pixel values or picture element values in an area may be created and the most common pixel value or picture element value may be used as a representative value. In addition, the value of an arbitrary pixel or picture element in an area may be used as a representative value.

Next, instead of using the extracted representative value as an evaluation value as it is, the image evaluating portion 21 divides 0 to 255 into a plurality of levels and uses the value of the level corresponding to the representative value as an evaluation value. Specifically, the image evaluating portion 21 divides 0 to 255 into equal four parts and sets 0 to 63 as "level 0", 64 to 127 as "level 1", 128 to 191 as "level 2", and 192 to 255 as "level 3". For example, since the representative value of the area 41*a* is 150, the evaluation value of the area 41*a* is "2".

In this manner, the image evaluating portion 21 identifies the evaluation values of the areas 41*a* to 41*e* and generates an evaluation value string (index) by arranging the identified evaluation values in order. Here, as depicted in FIG. 3(*c*), it is assumed that the evaluation value string is "2, 3, 3, 3, 2".

Incidentally, the above-described way to divide levels may be carried out in any manner. In this example, 0 to 255 are divided into four equal parts, but the number of levels, the level range, and so forth may be arbitrarily set. Moreover, the representative value may be used as an evaluation value as it is without level division.

Lastly, the image evaluating portion 21 identifies the maximum value of the picture elements included in the input image 41 as an overall evaluation value (frame level). Here, it is assumed that the overall evaluation value is "200". Incidentally, a method for identifying the overall evaluation value simply has to be the same as the above-described method for extracting the representative value.

As described above, the image evaluating portion 21 makes evaluations on the input image 41 by dividing the input image 41 into predetermined areas and converts it into numbers in the form of an evaluation value string. The luminance distribution of the input image 41 can be grasped as a broad tendency with respect to the direction in which the LEDs 13 are arranged, such as a positive slope, a negative slope, a partial distribution, and a uniform distribution, and treated as numbers. That is, the image evaluating portion 21 approximates the luminance distribution of the input image 41 with respect to the direction in which the LEDs 13 are arranged and converts it into numbers. Incidentally, the luminance distribution of the input image 41 is the distribution of the magnitudes of luminance observed when the input image 41 is displayed and corresponds to the distribution of pixel values or picture element values of the input image 41.

(A Processing Example of the LED Data Calculating Portion)

Next, a processing example of the LED data calculating portion 22 will be described.

Figure 4:
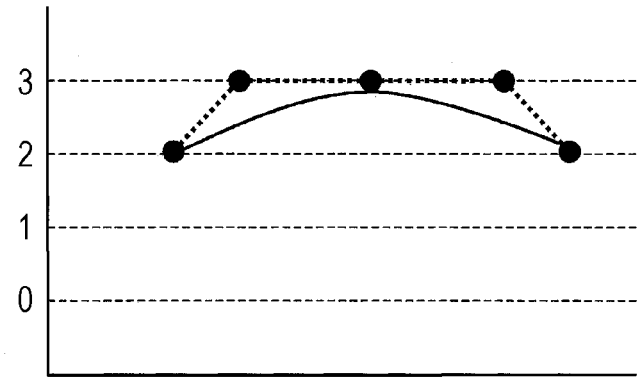
FIG. 4 is a diagram depicting an example of an approximate curve calculated from an evaluation value string.

When acquiring the evaluation value string from the image evaluating portion 21, the LED data calculating portion 22 generates an approximate curve based on the acquired evaluation value string. In this example, as depicted in FIG. 4, the LED data calculating portion 22 generates a secondary B spline curve based on the evaluation value string. Here, a shape is obtained by interpolation which is performed on the spaces between the evaluation values such that the number of plot points of the final B spline curve becomes the number of LEDs 13, that is, 48.

Here, the evaluation values are assumed to be $x_1$, $x_2$, . . . , $x_n$. Moreover, the number of divisions between the evaluation values is assumed to be m. Incidentally, (n−1)×m is equal to the number of LEDs 13.

B spline interpolation calculates a value obtained by interpolating the spaces between three points from the values of the three points. That is, interpolation between $x_1$ and $x_3$ and interpolation of $x_3$ to $x_5$, . . . , and $x_{n-2}$ to $x_n$ are performed. The evaluation values of the three points include 2m LED plot points. For example, a value $LEDP_j$ (0<j<2m) of LED plot points between $x_1$ and $x_3$ can be determined as follows:

$$LEDP_j=(1-j/2m)^2x_1+j/m(1-j/2m)x_2+(j/2m)^2x_3.$$

By performing this calculation sequentially, the values of all the LED plot points between $x_1$ and $x_n$ are calculated.

However, the LED data calculating portion 22 generates an approximate curve whose amount of change (gradient) is less than or equal to a predetermined value. In other words, the LED data calculating portion 22 generates an approximate curve in which the value of a difference between adjacent plot points becomes less than or equal to a predetermined value.

Incidentally, in this example, a secondary B spline curve is generated, but an arbitrary order may be used. By increasing the order, it is possible to perform dimming with a higher degree of accuracy. On the other hand, since the circuit size is increased with an increase in the order, the order is appropriately configured in accordance with an intended application. Moreover, in this example, a B spline curve is generated, but a method for generating an approximate curve may be an arbitrary method.

Figure 5:
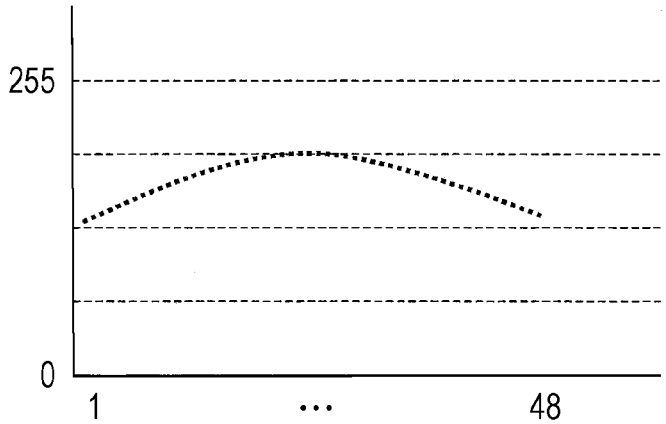
FIG. 5 is a diagram depicting an example of LED data calculated by mapping from an approximate curve.

Then, after generating the approximate curve as depicted in FIG. 5, the LED data calculating portion 22 calculates LED data by performing mapping to the LED data based on the interpolation values. At this time, the upper limit and lower limit bias of the LED data is configured separately and linear mapping is performed in such a way that the values of the LED data fall within that range. Incidentally, by increasing the upper limit of the LED data, it is possible to perform dimming while maintaining the image quality; by increasing the lower limit of the LED data, it is possible to further suppress a failure of video. On the other hand, by setting the upper limit and the lower limit at low values, it is possible to raise the low power consumption effects.

As described above, by calculating LED data based on an approximate curve obtained by approximating the distribution of pixel values or picture element values of an input image, the approximate curve whose amount of change is less than or equal to a predetermined value, it is possible to prevent a failure of display video which is caused locally.

Furthermore, by changing the method for generating an approximate curve depending on the model or the like of the liquid crystal display device 1, it is possible to deal with various requests flexibly. In general, a luminance diffusing filter used in the existing technique has to be made again in a different optical system; however, the use of the present invention eliminates the need for an optical simulation for each liquid crystal display device and a luminance diffusing filter for each optical system.

(A Processing Example of the Liquid Crystal Transmittance Calculating Portion)

Next, a processing example of the liquid crystal transmittance calculating portion 23 will be described. The liquid crystal transmittance calculating portion 23 derives a correction coefficient curve as described below based on the input image, the overall evaluation value, and the approximate curve and calculates the liquid crystal transmittance. Here, for example, a value obtained by subtracting the approximate curve from the maximum value of the evaluation value string (that is, a vertically-flipped shape) is used as a correction coefficient curve. Incidentally, the number of plot points of the approximate curve used in determining the LED data is the number of LEDs 13; in deriving the correction coefficient curve, an approximate curve having plot points whose number corresponds to the number of horizontal pixels of the liquid crystal panel 12 is calculated separately. At this time, let the number of horizontal pixels of the liquid crystal panel 12 be $Nh_{LCD}$ and the value of a plot point corresponding to a horizontal pixel in the j-th column in the approximate curve be $LCDP_j$, then $$LCD_rate(i,j)=Offset+(Index_Max-LCDP_j)/Index_Max$$

$$Assist(i,j,c)=(1-Cin(i,j,c))*LCD_rate(i,j)*K$$

$$Cout(i,j,c)=Cin(i,j,c)+(Cin(i,j,c)*Assist(i,j,c))$$

Here, "Cin(i,j,c)" is a picture element value (c=R or G or B) of a pixel in the i-th row and the j-th column of the input image. Moreover, "Cout(i,j,c)" is the liquid crystal transmittance of a picture element (c=R or G or B) of the pixel in the i-th row and the j-th column. Furthermore, "Assist(i,j,c)" is a correction coefficient. "K" is corrected intensity. "LCD_rate(i,j)" becomes an intermediate value for deriving the correction coefficient. In addition, "Offset" is a value obtained by converting the 8-bit overall evaluation value (frame level) to make it possible to perform a comparison with the approximate curve and the evaluation value string. Moreover, "Index_Max" is the maximum value of the evaluation value string (index).

Moreover, "$LCDP_j$" is calculated by the following equations.

$$LCDP_j=(1-j/2m)^2x_1+j/m(1-j/2m)x_2+(j/2m)^2x_3(0<j<2m)$$

$$LCDP_j=(1-j/2m)^2x_3+j/m(1-j/2m)x_4+(j/2m)^2x_5(2m<j<4m)$$

...

-continued $$LCDP_j = (1 - j/2m)^2 x_{n-2} + j/m(1 - j/2m)x_{n-1} + (j/2m)^2 x_n ((n-3)m < j < (n-1)m)$$

By performing this calculation sequentially, all "$LCDP_j$" between $x_1$ and $x_n$ are calculated. Incidentally, j is an integer and $0<j<Nh_{LCD}$ holds. Moreover, m is the number of divisions between the evaluation values, and (n−1)×m is equal to the number of horizontal pixels $Nh_{LCD}$. As described above, n is the number of evaluation values or the number of areas.

Figure 6:
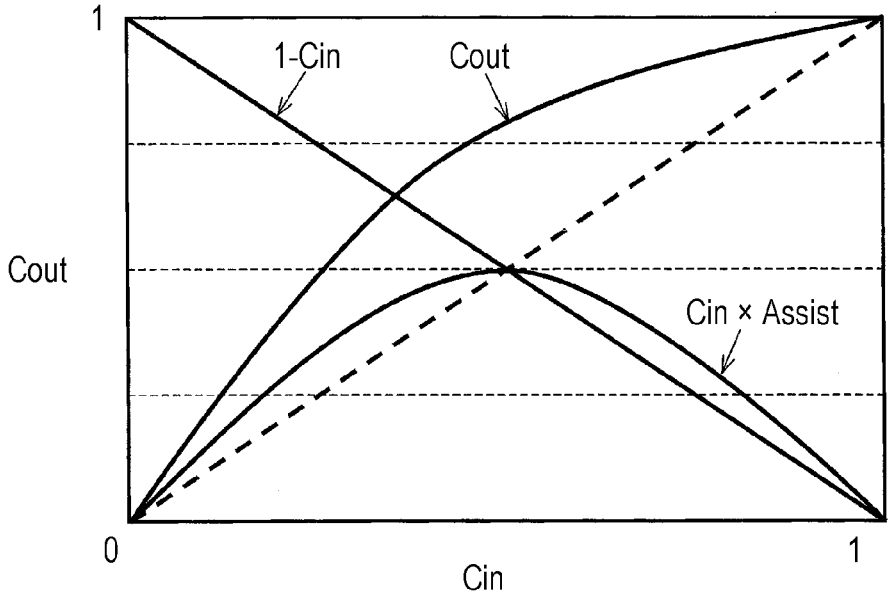
FIG. 6 is a diagram depicting the relationship between the picture element value of an input image and the liquid crystal transmittance.

Furthermore, in order to make "Cout(i,j,c)" take a value from 0 to 1, "Cin(i,j,c)" and "LCD_rate(i,j)" are standardized and "K" is assumed to be an arbitrary number from 0 to 1. The relationship between "Cout(i,j,c)" and "Cin(i,j,c)" in this example is depicted in FIG. 6. FIG. 6 is a diagram depicting the relationship between the picture element value of an input image and the liquid crystal transmittance. In FIG. 6, the horizontal axis is "Cin(i,j,c)" and the vertical axis is "Cout(i,j,c)".

Figure 8:
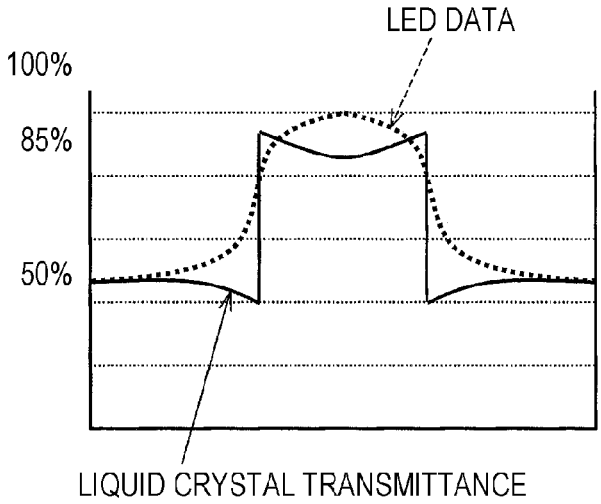
FIG. 8 is a diagram depicting, as a graph, an example of the LED data and the liquid crystal transmittance calculated when the input image depicted in FIG. 7 is input.

Since LED data is made smaller in accordance with the luminance distribution of an input image as depicted in FIG. 8 which will be described later, if the liquid crystal transmittance is not corrected, the display luminance is reduced. Therefore, by correcting the liquid crystal transmittance, it is possible to prevent a reduction in luminance. As depicted in FIG. 6, by making correction of halftones in a larger way and making correction in low and high gradations in a smaller way, it is possible to prevent gradation black crush.

(The Effects of the Present Invention)

Figure 7:
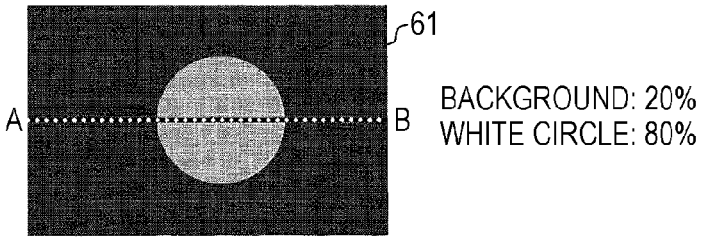
FIG. 7 is a diagram depicting an example of an input image.

Lastly, the output results of the portions observed when an input image 61 depicted in FIG. 7 is input will be described below.

First, the LED data calculated by the LED data calculating portion 22 and the liquid crystal transmittance calculated by the liquid crystal transmittance calculating portion 23 when the input image 61 depicted in FIG. 7 is input are depicted in FIG. 8 as a graph. In FIG. 8, the horizontal axis is an LED or a picture element (a pixel) corresponding to a position from the point A to the point B in FIG. 7 and the vertical axis is the value of the LED data or the liquid crystal transmittance.

Figure 9:
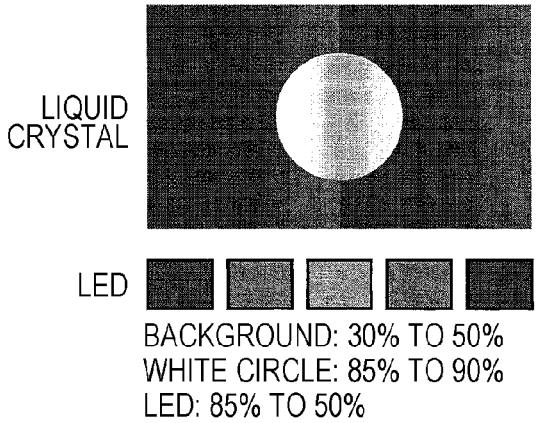
FIG. 9 is a diagram schematically depicting an example of the LED data and the liquid crystal transmittance calculated when the input image depicted in FIG. 7 is input.

Moreover, the LED data calculated by the LED data calculating portion 22 and the liquid crystal transmittance calculated by the liquid crystal transmittance calculating portion 23 are schematically depicted in FIG. 9. In FIG. 9, a shade of color indicates the LED data value of each LED 13 and the liquid crystal transmittance of a picture element (a pixel) on the image.

Figure 10:
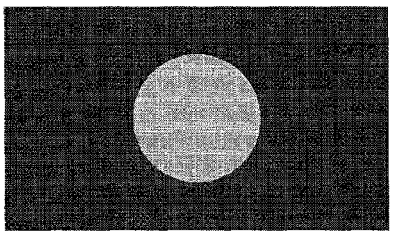
FIG. 10 is a diagram depicting a display image obtained when an LED driver drives LEDs based on the LED data depicted in FIG. 8 or 9 and a liquid crystal driver drives a liquid crystal panel based on the liquid crystal transmittance depicted in FIG. 8 or 9.

In addition, in FIG. 10, a display image observed when the LED driver 15 drives the LEDs 13 based on the LED data depicted in FIG. 8 or 9 and the liquid crystal driver 14 drives the liquid crystal panel 12 based on the liquid crystal transmittance depicted in FIG. 8 or 9 is depicted.

As described above, in the present invention, since the LED data and the liquid crystal transmittance are calculated based an approximate curve obtained by approximating an input image, the approximate curve whose amount of change is less than or equal to a predetermined value, as compared to the existing dimming method depicted in FIGS. 12 to 15, it is possible to prevent the occurrence of a local failure of video.

Modified Example 1

Figure 11:
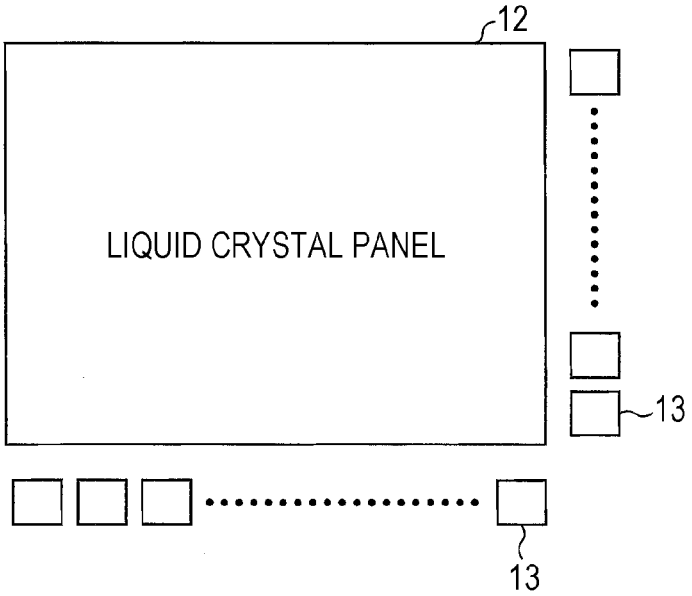
FIG. 11 is a diagram depicting LEDs arranged on two sides of the liquid crystal panel.

In this embodiment, the LEDs 13 are arranged only on the long side of the liquid crystal panel 12, but the arrangement is not limited thereto. For example, as depicted in FIG. 11, the LEDs 13 may be arranged along the long side and the short side of the liquid crystal panel 12. That is, light may be allowed to enter the liquid crystal panel 12 from the two sides thereof.

Figure 12:
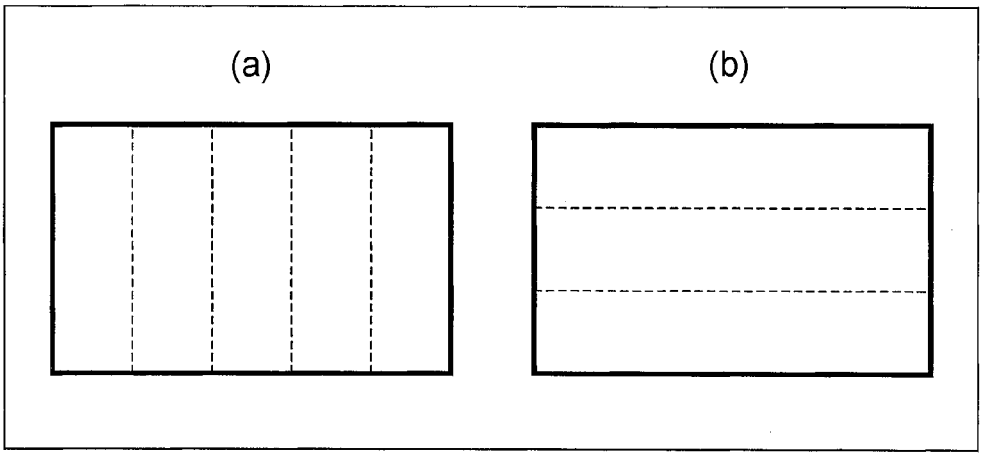
FIG. 12 is a diagram depicting two types of evaluation areas (a horizontal component evaluation area and a vertical component evaluation area).

In this case, as depicted in FIG. 12, the image evaluating portion 21 configures two types of evaluation areas (a horizontal component evaluation area and a vertical component evaluation area). Specifically, the image evaluating portion 21 vertically divides an input image into five evaluation areas (horizontal component evaluation areas) with respect to the long-side direction (horizontal direction) as depicted in FIG. 12(*a*). At the same time, the image evaluating portion 21 vertically divides the input image into three evaluation areas (vertical component evaluation areas) with respect to the short-side direction (vertical direction) as depicted in FIG. 12(*b*).

Then, the image evaluating portion 21 identifies an evaluation value for each of the horizontal component evaluation areas and generates an evaluation value string of the horizontal components. At the same time, the image evaluating portion 21 identifies an evaluation value for each of the vertical component evaluation areas and generates an evaluation value string of the vertical components. Moreover, the image evaluating portion 21 identifies an overall evaluation value.

Figure 13:
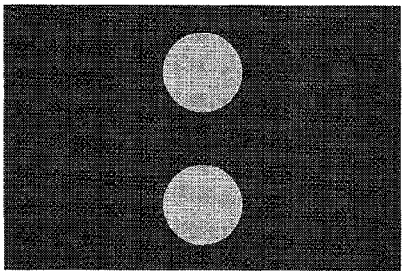
FIG. 13 is a diagram depicting an example of an input image.
Figure 14:
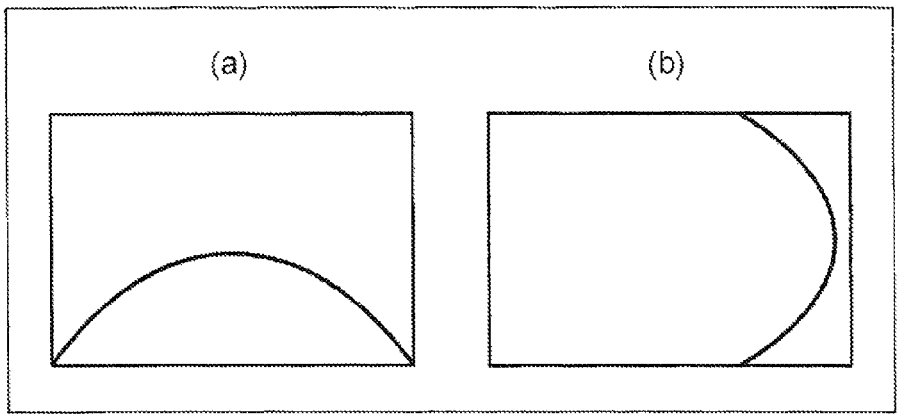
FIG. 14 is a diagram depicting an example of an approximate curve of horizontal components and an approximate curve of vertical components, the approximate curves generated from the input image depicted in FIG. 13.

Next, the LED data calculating portion 22 generates an approximate curve of the horizontal components, the approximate curve obtained by approximating the evaluation value string of the horizontal components. At the same time, the LED data calculating portion 22 generates an approximate curve of the vertical components, the approximate curve obtained by approximating the evaluation value string of the vertical components. For example, when an input image depicted in FIG. 13 is input, the LED data calculating portion 22 generates an approximate curve of horizontal components and an approximate curve of vertical components depicted in FIG. 14.

The LED data calculating portion 22 calculates LED data of the horizontal components by mapping the approximate curve of the horizontal components and calculates LED data of the vertical components by mapping the approximate curve of the vertical components. Here, the LED data of the horizontal components is the LED data of the LEDs 13 on the long side, and the LED data of the vertical components is the LED data of the LEDs 13 on the short side.

Next, the liquid crystal transmittance calculating portion 23 derives a correction coefficient curve as follows based on the input image, the overall evaluation value, and the approximate curve of the horizontal components and the approximate curve of the vertical components and calculates the liquid crystal transmittance. Here, a value obtained by subtracting the approximate curve from the maximum value of the evaluation value string (that is, a vertically-flipped shape) is determined for the horizontal components and the vertical components, and a value obtained by multiplying them is used as the correction coefficient curve.

$$\text{LCD_rate}(i,j)=\text{Offset}+(\text{Index_Max_}h-\text{LCDP}_j)*(\text{Index_Max_}v-\text{LCDP}_i)/(\text{Index_Max_}h*\text{Index_Max_}v)$$

$$\text{Assist}(i,j,c)=(1-\text{Cin}(i,j,c))*\text{LCD_rate}(i,j)*K$$

$$\text{Cout}(i,j,c)=\text{Cin}(i,j,c)+(\text{Cin}(i,j,c)*\text{Assist}(i,j,c))$$

Moreover, "$LCDP_j$" is calculated by the following equations.

$$LCDP_j = (1-j/2m_h)^2x_1 + j/m_h(1-j/2m_h)x_2 + (j/2m_h)^2x_3 (0<j<2m_h)$$

$$LCDP_j = (1-j/2m_h)^2x_3 + j/m_h(1-j/2m_h)x_4 + (j/2m_h)^2x_5 (2m_h<j<4m_h)$$

...

$$LCDP_j = (1-j/2m_h)^2x_{nh-2} + j/m_h(1-j/2m_h)x_{nh-1} + (j/2m_h)^2x_{nh} ((nh-3)m_h<j<(nh-1)m_h)$$

By performing this calculation sequentially, all "$LCDP_j$" between $x_1$ and $x_{nh}$ of the approximate curve of the horizontal components are calculated. Incidentally, j is an integer and $0<j<Nh_{LCD}$. Moreover, $m_h$ is the number of divisions between the evaluation values of the horizontal components, and $(nh-1)\times m_h$ is equal to the number of horizontal pixels $Nh_{LCD}$. nh is the number of horizontal component evaluation areas.

Furthermore, "$LCDP_i$" is calculated by the following equations.

$$LCDP_i = (1-i/2m_v)^2y_1 + i/m_v(1-i/2m_v)y_2 + (i/2m_v)^2y_3 (0<i<2m_v)$$

$$LCDP_i = (1-i/2m_v)^2y_3 + i/m_v(1-i/2m_v)y_4 + (i/2m_v)^2y_5 (2m_v<i<4m_v)$$

...

$$LCDP_i = (1-i/2m_v)^2y_{nv-2} + i/m_v(1-i/2m_v)y_{nv-1} + (i/2m_v)^2y_{nv} ((nv-3)m_v<i<(nv-1)m_v)$$

By performing this calculation sequentially, all "$LCDP_i$" between $y_1$ and $y_{nv}$ of the approximate curve of the vertical components are calculated. Incidentally, i is an integer and $0<i<Nv_{LCD}$. Moreover, $m_v$ is the number of divisions between the evaluation values of the vertical components, and $(nv-1)\times m_v$ is equal to the number of vertical pixels $Nv_{LCD}$. nv is the number of vertical component evaluation areas.

Furthermore, in order to make "Cout(i,j,c)" take a value from 0 to 1, "Cin(i,j,c)" and "LCD_rate(i,j)" are standardized and "K" is assumed to be an arbitrary number from 0 to 1.

Modified Example 2

Figure 15:
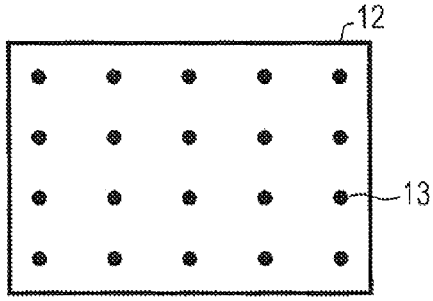
FIG. 15 is a diagram depicting LEDs arranged in a matrix on the back of the liquid crystal panel.

In this embodiment, the LEDs 13 are arranged on the long side of the liquid crystal panel 12, but the arrangement is not limited thereto. For example, as depicted in FIG. 15, the LEDs 13 may be arranged in a matrix on the back of the liquid crystal panel 12. Here, it is assumed that 27×48 LEDs 13 are arranged.

In this case, as is the case with modified example 1 described above, the image evaluating portion 21 configures two types of evaluation areas (a horizontal component evaluation area and a vertical component evaluation area) and generates an evaluation value string of the horizontal components and an evaluation value string of the vertical components. Moreover, the image evaluating portion 21 identifies an overall evaluation value.

Next, the LED data calculating portion 22 generates an approximate curve of the horizontal components and an approximate curve of the vertical components corresponding to the evaluation value string of the horizontal components and the evaluation value string of the vertical components, respectively. Then, the LED data calculating portion 22 calculates LED data of the horizontal components and LED data of the vertical components from the approximate curve of the horizontal components and the approximate curve of the vertical components, respectively.

Here, if the LED data of the horizontal components and the LED data of the vertical components are assumed to be "LED_data_h_#n" and "LED_data_v_#m", LED data of m×n LEDs 13 is calculated as follows:

$$LED_data_f(m,n) = (LED_data_h_\#n + LED_data_v_\#m)/2 \text{ or}$$

$$LED_data_f(m,n) = LED_data_h_\#n * LED_data_v_\#m.$$

Next, as is the case with modified example 1 described above, the liquid crystal transmittance calculating portion 23 calculates the liquid crystal transmittance based on the input image, the overall evaluation value, and the approximate curve of the horizontal components and the approximate curve of the vertical components.

Modified Example 3

In this embodiment, the amount of change in LED data is set so as to be less than or equal to a predetermined value in a physical dimension; in addition, the amount of change in LED data may be set so as to be less than or equal to a predetermined value in a temporal dimension.

Figure 16:
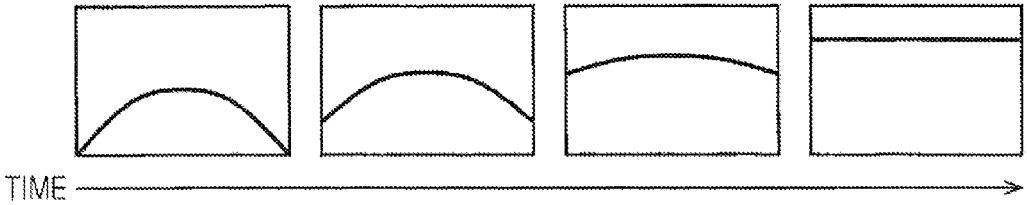
FIG. 16 is a diagram depicting temporal changes of each LED data for a plurality of input images which are continuously input.
Figure 17:
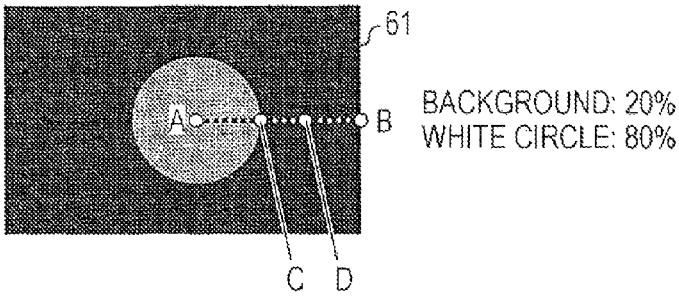
FIG. 17 Conventional Art
FIG. 17 is a diagram depicting an example of an input image.
Figure 18:
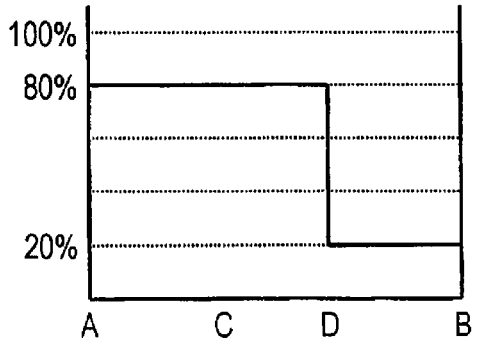
FIG. 18 Conventional Art
FIG. 18 depicts an existing technique and is a diagram depicting an example of LED data observed when the input image depicted in FIG. 17 is input.
Figure 19:
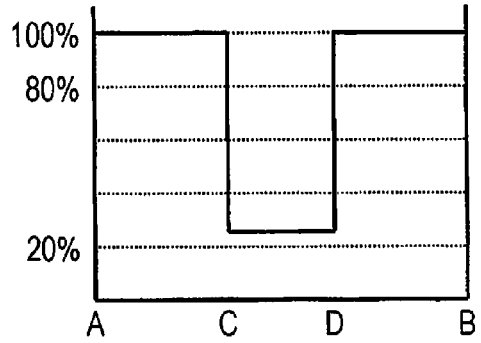
FIG. 19 Conventional Art
FIG. 19 depicts the existing technique and is a diagram depicting the liquid crystal transmittance observed when the input image depicted in FIG. 17 is input.
Figure 20:
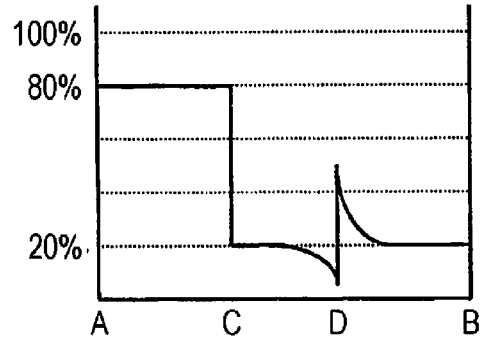
FIG. 20 Conventional Art
FIG. 20 depicts the existing technique and is a diagram depicting the display luminance distribution observed when an LED driver drives LEDs based on the LED data depicted in FIG. 18 and a liquid crystal driver drives a liquid crystal panel based on the liquid crystal transmittance depicted in FIG. 19.
Figure 21:
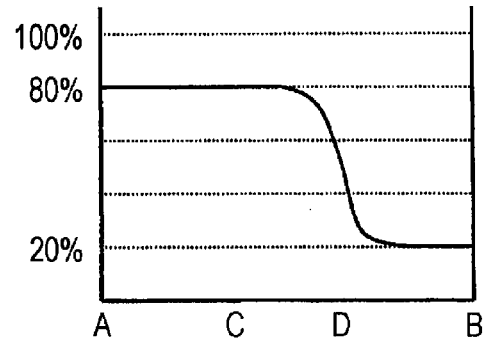
FIG. 21 Conventional Art
FIG. 21 depicts the existing technique and is a diagram depicting the actual luminance distribution observed when the LED driver drives the LEDs based on the LED data depicted in FIG. 18.
Figure 22:
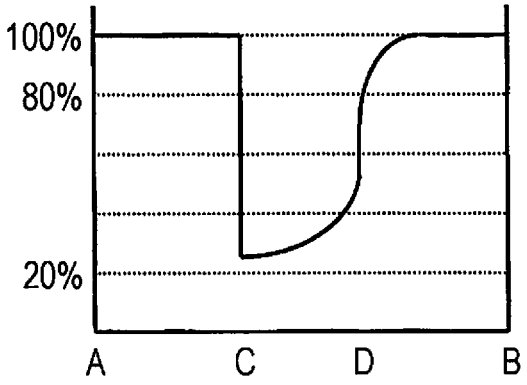
FIG. 22 Conventional Art
FIG. 22 depicts the existing technique and is a diagram depicting the liquid crystal transmittance corrected in consideration of the actual luminance distribution when the input image depicted in FIG. 17 is input.
Figure 23:
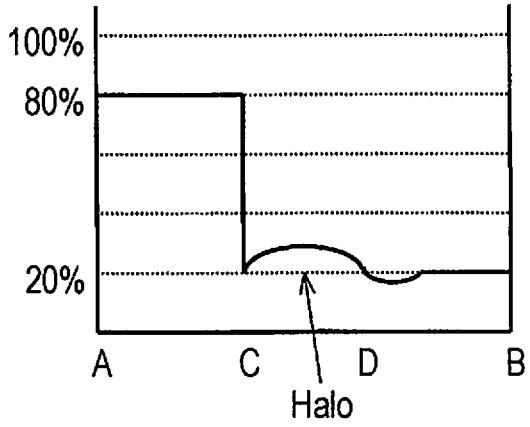
FIG. 23 Conventional Art
FIG. 23 depicts the existing technique and is a diagram depicting the display luminance distribution observed when the LED driver drives the LEDs based on the LED data depicted in FIG. 18 and the liquid crystal driver drives the liquid crystal panel based on the liquid crystal transmittance depicted in FIG. 22.

Specifically, as depicted in FIG. 16, when moving images are displayed, LED data may be determined in such a way that a difference between LED data for a certain input image and LED data for the next input image becomes less than or equal to a predetermined value. For example, LED data (LED_out) for a certain input image may be determined as follows:

$$LED_out = Pre_LED + (New_LED - Pre_LED) * T.$$

Here, "Pre_LED" is LED data for an input image before the certain input image described above (is "LED_out" for an input image before the certain input image). Moreover, "New_LED" is LED data calculated from the approximate curve obtained by approximating the evaluation value string generated from the certain input image. "T" is a correction coefficient and is assumed to be an arbitrary number from 0 to 1.

Moreover, in a temporal dimension, the amount of change in an intermediate value "LCD_rate(i,j)" used to derive the liquid crystal transmittance may be set so as to be less than or equal to a predetermined value.

Specifically, when moving images are displayed, the intermediate value may be determined in such a way that a difference between the intermediate value used to derive the liquid crystal transmittance of a certain input image and the intermediate value used to derive the liquid crystal transmittance of the next input image becomes less than or equal to a predetermined value. For example, an intermediate value "LCD_rate(i,j)" for a certain input image may be determined as follows:

$$LCD_rate(i,j) = Pre_LCD_rate(i,j) + (New_LCD_rate(i,j) - Pre_LCD_rate(i,j)) * T.$$

Here, "Pre_LCD_rate(i,j)" is an intermediate value for an input image before the certain input image described above (is "LCD_rate(i,j)" for an input image before the certain input image). Moreover, "New_LCD_rate(i,j)" is an intermediate value calculated from the approximate curve obtained by approximating the evaluation value string generated from the certain input image. "T" is a correction coefficient and is assumed to be an arbitrary number from 0 to 1.

As a result, since the luminance of the LED 13 gradually changes, it is possible to prevent the occurrence of flicker or the like at the time of sudden change of video such as change of scenes.

Modified Example 4

In this embodiment, as a display device, a liquid crystal display device equipped with a liquid crystal panel is depicted as an example, but the display device is not limited thereto. Any display device may be used as long as the display device has a backlight and can configure the light transmittance of a display panel, and the display device may be, for example, a sign such as color Colton.

[Supplemental Remarks]

The present invention is not limited to the embodiment described above and can be changed in various ways within the scope of the claims. That is, an embodiment which is obtained by combining the technical means appropriately changed within the scope of the claims is also included in the technical scope of the present invention.

Lastly, each block of the liquid crystal display device 1, in particular, the controlling portion 11 may be configured by using hardware logic or may be implemented by software by using a CPU as follows.

That is, the liquid crystal display device 1 includes a central processing unit (CPU) that executes an instruction of a control program implementing the functions, read only memory (ROM) storing the above-described program, random access memory (RAM) in which the above-described program is expanded, a storage device (a recording medium), such as memory, which stores the above-described program and various data, and so forth. Then, the object of the present invention can also be achieved by supplying a recording medium on which a program code (an execute format program, an intermediate code program, a source program) of the control program of the liquid crystal display device 1 which is software implementing the above-described functions is recorded in such a way as to allow a computer to read the program code to the liquid crystal display device 1 and making the computer (or the CPU or the MPU) read and execute the program code recorded on the recording medium.

As the recording medium described above, for example, tapes such as magnetic tapes and cassette tapes, disks including magnetic disks such as Floppy® disks/hard disks and optical disks such as CD-ROMs/MOs/MDs/DVDs/CD-Rs, cards such as IC cards (including memory cards)/optical cards, semiconductor memory such as mask ROM/EPROM/EEPROM®/flash ROM, or the like can be used.

Moreover, the liquid crystal display device 1 may be configured so as to be connectable to a communication network, and the above-described program code may be supplied thereto via the communication network. This communication network is not limited to a particular communication network, and, for example, the Internet, an intranet, an extranet, a LAN, an ISDN, a VAN, a CATV communication network, a virtual private network, a telephone network, a mobile communication network, a satellite communication network, and so forth can be used. Moreover, a transmission medium forming the communication network is not limited to a particular transmission medium, and, for example, both wired media such as IEEE1394, a USB, a power-line carrier, a cable TV circuit, a telephone line, and an ADSL and wireless media such as infrared radiation such as IrDA and remote control, Bluetooth®, 802.11 radio, HDR, a mobile telephone network, a satellite circuit, and a terrestrial digital network can be used. Incidentally, the present invention can also be implemented in the form of a computer data signal embedded in a carrier wave, the computer data signal which is an embodiment of the above-described program code by electronic transmission.

INDUSTRIAL APPLICABILITY

The present invention can be used in an image display device having the function of controlling the luminance of a backlight based on an input image.

REFERENCE SIGNS LIST

1 liquid crystal display device (image display device)
11 controlling portion
12 liquid crystal panel (display panel)
13 LED (light source)
14 liquid crystal driver (display panel driving means)
15 LED driver (light source driving means)
21 image evaluating portion (image evaluating means)
22 LED data calculating portion (approximate curve generating means, light source data calculating means)
23 liquid crystal transmittance calculating portion (light transmittance calculating means)

The invention claimed is:

1. An image display device in which a plurality of light sources are arranged in a matrix on a back of a display panel, the image display device comprising:

an approximate curve generating module to generate a horizontal component approximate curve and a vertical component approximate curve by approximating a distribution of values of an input image, the horizontal component approximate curve and the vertical component approximate curve including amounts of change are less than or equal to a predetermined value;

a light source data calculating module to calculate light source data for controlling outputs of the plurality of light sources based on the horizontal component approximate curve and the vertical component approximate curve generated by the approximate curve generating module;

a light transmittance calculating module to calculate a light transmittance for controlling a light transmittance of the display panel based on the input image and the horizontal component approximate curve and the vertical component approximate curve generated by the approximate curve generating module;

a light source driving circuit to drive the plurality of light sources based on the light source data calculated by the light source data calculating module;

a display panel driving circuit to drive the display panel based on the light transmittance calculated by the light transmittance calculating module; and an image evaluating module to divide the input image into a plurality of areas with respect to a horizontal direction and a vertical direction, identify an evaluation value indicating a magnitude of a luminance of each area, and generate an evaluation value string of horizontal components and an evaluation value string of vertical components in which the evaluation values of the areas are arranged in order with respect to the horizontal direction and the vertical direction, respectively, wherein the generating of the respective horizontal component approximate curve and the vertical component approximate curve includes approximating the evaluation value string of the horizontal components and the evaluation value string of the vertical components, respectively.

2. A method for controlling an image display device in which a plurality of light sources are arranged along one side or two sides of a display panel, the method comprising:

generating a horizontal component approximate curve and a vertical component approximate curve, by approximating a distribution of values of an input image, the horizontal component approximate curve and the vertical component approximate curve including amounts of change not exceeding a threshold value of change;

calculating light source data to control outputs of the plurality of light sources based on the generated horizontal component approximate curve and the vertical component approximate curve;

calculating a light transmittance to control a light transmittance of the display panel based on the input image and the generated horizontal component approximate curve and the generated vertical component approximate curve generated;

driving the plurality of light sources based on the calculated light source data;

driving the display panel based on the calculated light transmittance; and dividing the input image into a plurality of areas with respect to a horizontal direction and a vertical direction, identifying an evaluation value indicating a magnitude of a luminance of each of the plurality of areas, and generating an evaluation value string of horizontal components and an evaluation value string of vertical components in which the evaluation values of the plurality of areas are arranged in order with respect to the horizontal direction and the vertical direction, respectively, wherein the generating of the respective horizontal component approximate curve and the respective vertical component approximate curve includes approximating the evaluation value string of the horizontal components and the evaluation value string of the vertical components, respectively.

3. A non-transitory computer readable medium comprising computer readable instructions which, when executed by one or more processors of an image display device, carry out the method of claim 2.

4. An image display device in which a plurality of light sources are arranged in a matrix on a back of a display panel, the image display device comprising:

a memory storing computer-readable instructions;

one or more processors configured to execute the computer-readable instructions such that the one or more processors are configured to generate a horizontal component approximate curve and a vertical component approximate curve, by approximating a distribution of values of an input image, the horizontal component approximate curve and the vertical component approximate curve including amounts of change not exceeding a threshold value of change, calculate light source data to control outputs of the plurality of light sources based on the generated horizontal component approximate curve and the vertical component approximate curve, calculate a light transmittance to control a light transmittance of the display panel based on the input image and the generated horizontal component approximate curve and the generated vertical component approximate curve generated;

a light source driving circuit to drive the plurality of light sources based on the calculated light source data; and a display panel driving circuit to drive the display panel based on the calculated light transmittance, wherein the one or more processors are further configured to execute the computer-readable instructions such that the one or more processors are further configured to divide the input image into a plurality of areas with respect to a horizontal direction and a vertical direction, identify an evaluation value indicating a magnitude of a luminance of each of the plurality of areas, and generate an evaluation value string of horizontal components and an evaluation value string of vertical components in which the evaluation values of the plurality of areas are arranged in order with respect to the horizontal direction and the vertical direction, respectively, wherein the generating of the respective horizontal component approximate curve and the respective vertical component approximate curve includes approximating the evaluation value string of the horizontal components and the evaluation value string of the vertical components, respectively.

* * * * *